US011000729B2

(12) United States Patent
Chuang

(10) Patent No.: US 11,000,729 B2
(45) Date of Patent: May 11, 2021

(54) FITNESS EQUIPMENT

(71) Applicant: Lung-Fei Chuang, Taichung (TW)

(72) Inventor: Lung-Fei Chuang, Taichung (TW)

( * ) Notice: Subject to any disclaimer, the term of this patent is extended or adjusted under 35 U.S.C. 154(b) by 46 days.

(21) Appl. No.: 16/296,246

(22) Filed: Mar. 8, 2019

(65) Prior Publication Data

US 2020/0086169 A1 Mar. 19, 2020

(30) Foreign Application Priority Data

Sep. 13, 2018 (CN) ..... 201821496240.5

(51) Int. Cl.

| | |
|---|---|
| ***A63B 22/06*** | (2006.01) |
| ***A63B 22/00*** | (2006.01) |
| ***A63B 23/02*** | (2006.01) |
| ***A63B 23/04*** | (2006.01) |

(52) U.S. Cl.

CPC ..... *A63B 22/0605* (2013.01); *A63B 22/0046* (2013.01); *A63B 23/0205* (2013.01); *A63B 23/0476* (2013.01); *A63B 2022/0629* (2013.01); *A63B 2022/0635* (2013.01); *A63B 2022/0647* (2013.01); *A63B 2022/0652* (2013.01); *A63B 2208/0233* (2013.01); *A63B 2208/0257* (2013.01); *A63B 2225/09* (2013.01)

(58) Field of Classification Search

CPC .... A63B 2022/0629; A63B 2022/0647; A63B 2022/0635; A63B 2022/0652; A63B 22/0046; A63B 22/0605; A63B 22/0205; A63B 22/0476; A63B 23/0205; A63B 23/0476; A63B 23/1227; A63B 23/1236; A63B 2208/0257; A63B 2208/0228; A63B 2208/0233; A63B 2208/0238; A63B 2210/50; A63B 2210/09

See application file for complete search history.

(56) References Cited

U.S. PATENT DOCUMENTS

| | | | | |
|---|---|---|---|---|
| 9,744,401 | B2 * | 8/2017 | Lalaoua | A63B 22/201 |
| 9,750,343 | B2 * | 9/2017 | McBride | A63B 22/0605 |
| 10,561,892 | B2 * | 2/2020 | Johnson | A63B 22/0605 |
| D899,534 | S * | 10/2020 | Chuang | D21/667 |
| 2012/0322625 | A1 * | 12/2012 | Park | A63B 22/0005 482/62 |
| 2013/0260967 | A1 * | 10/2013 | Chia | A63B 22/0605 482/57 |

* cited by examiner

*Primary Examiner* — Megan Anderson
(74) *Attorney, Agent, or Firm* — CKC & Partners Co., LLC

(57) ABSTRACT

A fitness equipment includes a main body, a binding structure and a support base. The main body is supported on the ground and includes a pedal unit. The binding structure is disposed on the main body. The support base is detachably pivoted to the binding structure and is rotatable correspondingly to the main body, wherein the support base includes a seat, a handlebar and a connecting structure. The handlebar is disposed on the seat. The connecting structure is disposed on the seat and detachably pivoted to the binding structure.

9 Claims, 17 Drawing Sheets

FITNESS EQUIPMENT

RELATED APPLICATIONS

This application claims priority to CN Application Serial Number 201821496240.5, filed Sep. 13, 2018, which is herein incorporated by reference.

BACKGROUND

Technical Field

The present disclosure relates to a fitness equipment. More particularly, the present disclosure relates to a pedal fitness equipment capable of adjusting an exercise mode.

Description of Related Art

Recently, human beings gradually pay attention to their own health and posture. However, due to restrictions on sports venues and time, small fitness equipment such as treadmills and exercise bikes, which can be used indoors, have been developed.

Conventional fitness equipment has advantages, such as simple structure and convenient use, and suitable fitness equipment also can be selected according to different needs. Thus, the fitness equipment becomes very popular. However, the conventional fitness equipment has only one exercise mode for training a specific part of body. Using the pedal fitness equipment as an example, the user can step on the pedals by his two feet and then do the exercise as similar as riding a bicycle when the user sits on the seat of the pedal fitness equipment so as to exercise the lower limbs thereof. However, the user needs to buy extra-equipment for exercising other parts of the body, such as the trunk and the upper limbs. Accordingly, the cost spent on fitness will be raised, and it requires more space for simultaneously using different fitness equipment.

In order to solve such the problems, a manufacturer develops a fitness equipment with multi-function. A main body of the aforementioned fitness equipment has different body-building arrangements, such as a reciprocating stretch handle and a pedal, for exercising the upper limbs, the lower limbs and other parts of the body simultaneously. However, in order to satisfy different demands of fitness, the fitness equipment with multi-function is huger and heavier, so that more space must be occupied when using different fitness structures. Thus, such the fitness equipment is not as convenient as predict.

Therefore, how to provide a fitness equipment, which can simultaneously meet the requirements of convenience and different exercise modes, has become a technical task with commercial values.

SUMMARY

According to one aspect of the present disclosure, a fitness equipment includes a main body, a binding structure and a support base. The main body is supported on the ground and includes a pedal unit. The binding structure is disposed on the main body. The support base is detachably pivoted to the binding structure and is rotatable correspondingly to the main body, wherein the support base includes a seat, a handlebar and a connecting structure. The handlebar is disposed on the seat. The connecting structure is disposed on the seat and detachably pivoted to the binding structure.

According to another aspect of the present disclosure, a fitness equipment includes a main body, a binding structure and a support base. The main body is supported on the ground and includes a pedal unit. The binding structure is disposed on the main body. The support base is detachably disposed at the binding structure and includes a seat, a handlebar and a connecting structure. The handlebar is disposed on the seat. The connecting structure is disposed on the seat and detachably connected to the binding structure.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
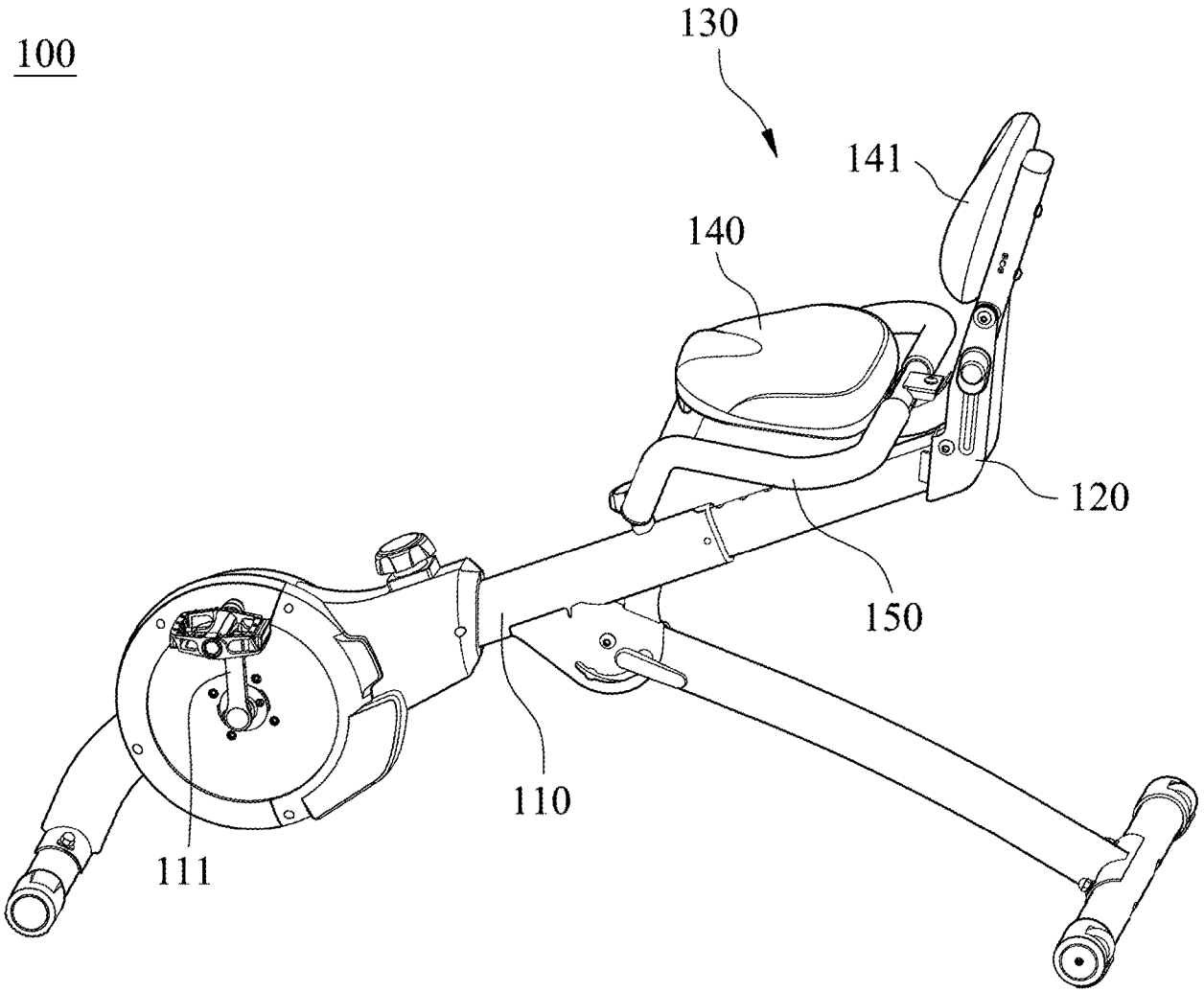
FIG. 1 is a schematic view of a fitness equipment according to one example of one embodiment of the present disclosure.
Figure 2:
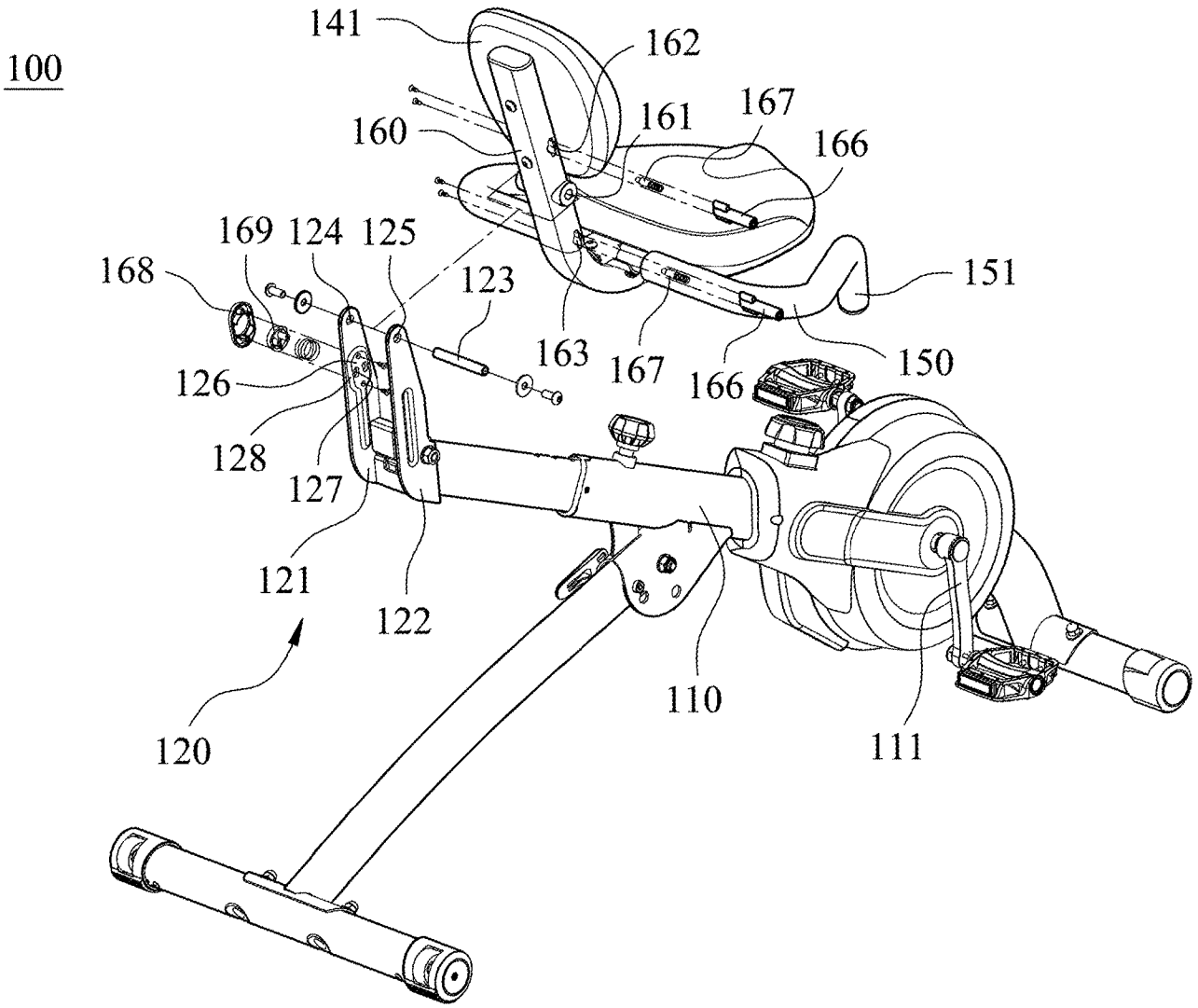
FIG. 2 is a connection exploded view of a support base and a binding structure of the fitness equipment of FIG. 1.

Please refer to FIG. 1 and FIG. 2. FIG. 1 is a schematic view of a fitness equipment 100 according to one example of one embodiment of the present disclosure, and FIG. 2 is a connection exploded view of a support base 130 and a binding structure 120 of the fitness equipment 100 of FIG. 1. The fitness equipment 100 includes a main body 110, the binding structure 120 and the support base 130.

The main body 110 is supported on the ground and includes a pedal unit 111. The binding structure 120 is disposed on the main body 110. The support base 130 is detachably pivoted to the binding structure 120 and is rotatable correspondingly to the main body 110, wherein the support base 130 includes a seat 140, a handlebar 150 and a connecting structure 160. The handlebar 150 is disposed on the seat 140. More preferably, in the embodiment of FIG. 2, each of two ends of the handlebar 150 can be bent to form a grip portion 151 for holding by a user. Therefore, the safety of using the fitness equipment 100 of the present disclosure can be enhanced. The connecting structure 160 is disposed on the seat 140 and detachably pivoted to the binding structure 120. More preferably, in the embodiment of FIG. 1, the seat 140 can include a seat back 141 so that the connecting structure 160 can be disposed on the seat back 141. Accordingly, by using the support base 130 of the present disclosure, the arrangement of the support base 130, which can rotate correspondingly to the main body 110, can be changed according to the actual demands without detaching the whole support base 130 from the main body 110. It is favorable for the user to change the exercise mode during the body-building process and exercise different parts of the body. Therefore, the fitness equipment 100 of the present disclosure can be operated more conveniently and applied broadly.

In the embodiment of FIG. 2, the connecting structure 160 can include two via holes 161 (only one via hole 161 is shown in FIG. 2). The two via holes 161 are opposite and connected to each other, wherein the binding structure 120 can include a first connecting plate 121, a second connecting plate 122 and a connecting unit 123. The first connecting plate 121 is disposed on the main body 110 and includes a first end through hole 124. The second connecting plate 122 is disposed on the main body 110 and includes a second end through hole 125, wherein the first connecting plate 121 and the second connecting plate 122 are opposite to each other. The connecting unit 123 sequentially passes through the first end through hole 124 of the first connecting plate 121, one of the via holes 161, the other one of the via holes 161 and the second end through hole 125 of the second connecting plate 122 so as to connect the connecting structure 160 with the binding structure 120. Preferably, as shown in FIG. 2, the connecting structure 160 can further include a first mounting hole 162, a first opening 164 (as shown in FIG. 3B), a second mounting hole 163, a second opening 165 (as shown in FIG. 3B) and two resilient buckles 166. The first mounting hole 162 is disposed on one side, which is close to the second connecting plate 122, of the connecting structure 160. The first opening 164 is disposed on one side, which is close to the first connecting plate 121, of the connecting structure 160, wherein the first mounting hole 162 and the first opening 164 are opposite and connected to each other. The second mounting hole 163 is disposed on one side, which is close to the second connecting plate 122, of the connecting structure 160, and the second mounting hole 163 and the first mounting hole 162 are separately disposed. The second opening 165 is disposed on one side, which is close to the first connecting plate 121, of the connecting structure 160. The second mounting hole 163 and the second opening 165 are opposite and connected to each other, and the first opening 164 and the second opening 165 are disposed at two sides of the two via holes 161, respectively. The two resilient buckles 166 are respectively disposed in the connecting structure 160. Each of the resilient buckles 166 includes an engagement block 167, which is repositioned disposed on one end of each of the resilient buckles 166. One of the engagement blocks 167 of the resilient buckles 166 is correspondingly disposed on and protruded out of the first opening 164, and the other one of the engagement blocks 167 of the resilient buckles 166 is correspondingly disposed on and protruded out of the second opening 165. In details, the resilient buckle 166 will sequentially pass the first mounting hole 162 and the first opening 164 to allow the engagement block 167 thereof embedding into the first opening 164. The other resilient buckle 166 will sequentially pass the second mounting hole 163 and the second opening 165 to allow the engagement block 167 thereof embedding into the second opening 165. Thus, the two resilient buckles 166 are disposed in the connecting structure 160. The two resilient buckles 166 also can be fixed to the connecting structure 160 by a locking mechanism but not limited by the examples above. Accordingly, by using the connecting unit 123, the support base 130 can pass through the first end through hole 124 of the first connecting plate 121, the second end through hole 125 of the second connecting plate 122 and the two via holes 161 of the connecting structure 160 so as to connect with the binding structure 120 and be rotatable correspondingly to the main body 110. The two engagement blocks 167 of the two resilient buckles 166 can be limited by the first opening 164 and the second opening 165, respectively, so that the two resilient buckles 166 are fixed in the connecting structure 160. The two engagement blocks 167 of the two resilient buckles 166 can be engaged at the first connecting plate 121 for preventing the support base 130 from moving or shaking correspondingly to the binding structure 120. Thus, the connection and the connecting strength between the support base 130 and the binding structure 120 will be reinforced. Furthermore, because the support base 130 is detachable and rotatable correspondingly to the main body 110, the fitness equipment 100 of the present disclosure can change the arrangement of the support base 130 according to the actual demands without releasing the connection between the support base 130 and the binding structure 120. Thus, the size and occupied space of the fitness equipment 100 can be effectively reduced, and the demand for different exercise modes can be further satisfied so as to improve the convenience of using the fitness equipment.

In the embodiment of FIG. 2, the first connecting plate 121 can further includes a positioning portion 126. The positioning portion 126 is disposed on a surface of the first connecting plate 121, which is oriented to the second connecting plate 122. The positioning portion 126 includes at least one recess hole 127 and two inclined portions 128 (only one of the inclined portions 128 is shown in FIG. 2). When a major axis of the binding structure 120 is parallel to a major axis of the connecting structure 160, the recess hole 127 of the first connecting plate 121 is configured for limiting the engagement block 167 of the resilient buckle 166. The two inclined portions 128 are disposed on the positioning portion 126 and located at two sides of the recess hole 127, respectively. Therefore, the engagement block 167 of each of the resilient buckles 166 can be engaged into the recess hole 127 through the guide of the inclined portion 128 so that the movement and shake of the support base 130 can be prevented during the body-building process. Furthermore, the positioning portion 126 can be disposed on the first connecting plate 121 by a stamping process or a sheet-metal working method. An additional protruding portion (not shown in the figure) also can be formed by the stamping process or the sheet-metal working method so as to be engaged with the engagement block 167 of each of the resilient buckles 166. However, the present disclosure will not be limited thereto.

Furthermore, in the embodiment of FIG. 2, the binding structure 120 can further include a button assembly 168. The button assembly 168 is correspondingly disposed on the recess hole 127 of the first connecting plate 121 for pressing the engagement block 167 of the resilient buckle 166, which is limited within the recess hole 127, so as to allow the engagement block 167 to be released from the limitation of the recess hole 127. It is favorable for the support base 130 to be released from the binding structure 120 and then rotated so as to operate the fitness equipment 100 more conveniently.

As shown in FIG. 2, the number of the recess hole 127 of the first connecting plate 121 can be two, and the two recess holes 127 are provided for limiting the two engagement blocks 167 of the resilient buckles 166, respectively. The button assembly 168 can further include at least one abutting tube 169 correspondingly disposed on one of the recess holes 127. When the user presses the button assembly 168, the abutting tube 169 abuts the engagement block 167 of the resilient buckle 166, which is limited in the recess hole 127, to allow the engagement block 167 retracting due to the pressing of the user. Then, the engagement block 167 will be released from the recess hole 127 and return after releasing from the limitation of the recess hole 127. It is favorable for rotating the support base 130 and changing the arrangement of the support base 130 correspondingly to the main body 110 so as to effectively improve the convenience of the fitness equipment 100 for using.

Furthermore, in the embodiment of FIG. 2, the number of the abutting tube 169 can be two. The two abutting tubes 169 are correspondingly disposed on the two recess holes 127, respectively, for pressing the two engagement blocks 167 limited in the recess holes 127. However, the present disclosure is not limited thereto.

Figure 3A:
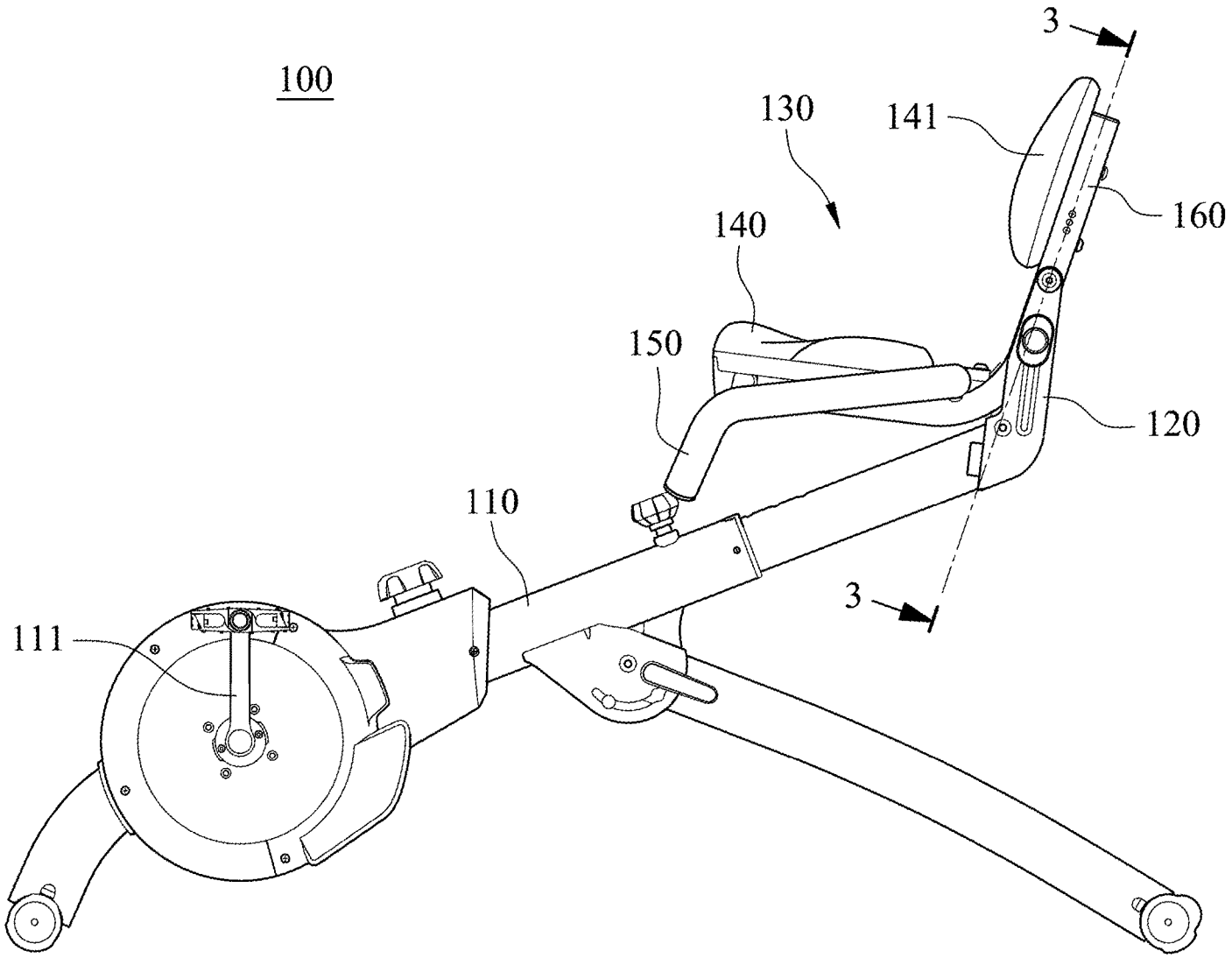
FIG. 3A is a schematic view showing a connection state of the support base of the fitness equipment of FIG. 1.
Figure 3B:
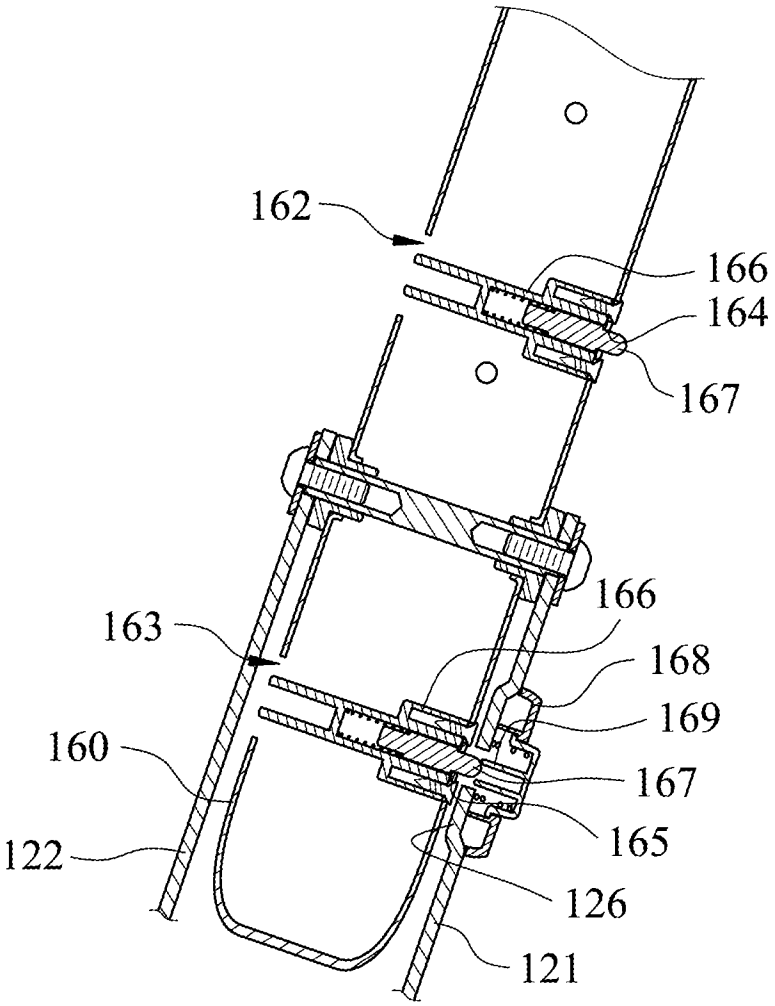
FIG. 3B is a cross-sectional view of the fitness equipment along a section line 3-3 of FIG. 3A.
Figure 4A:
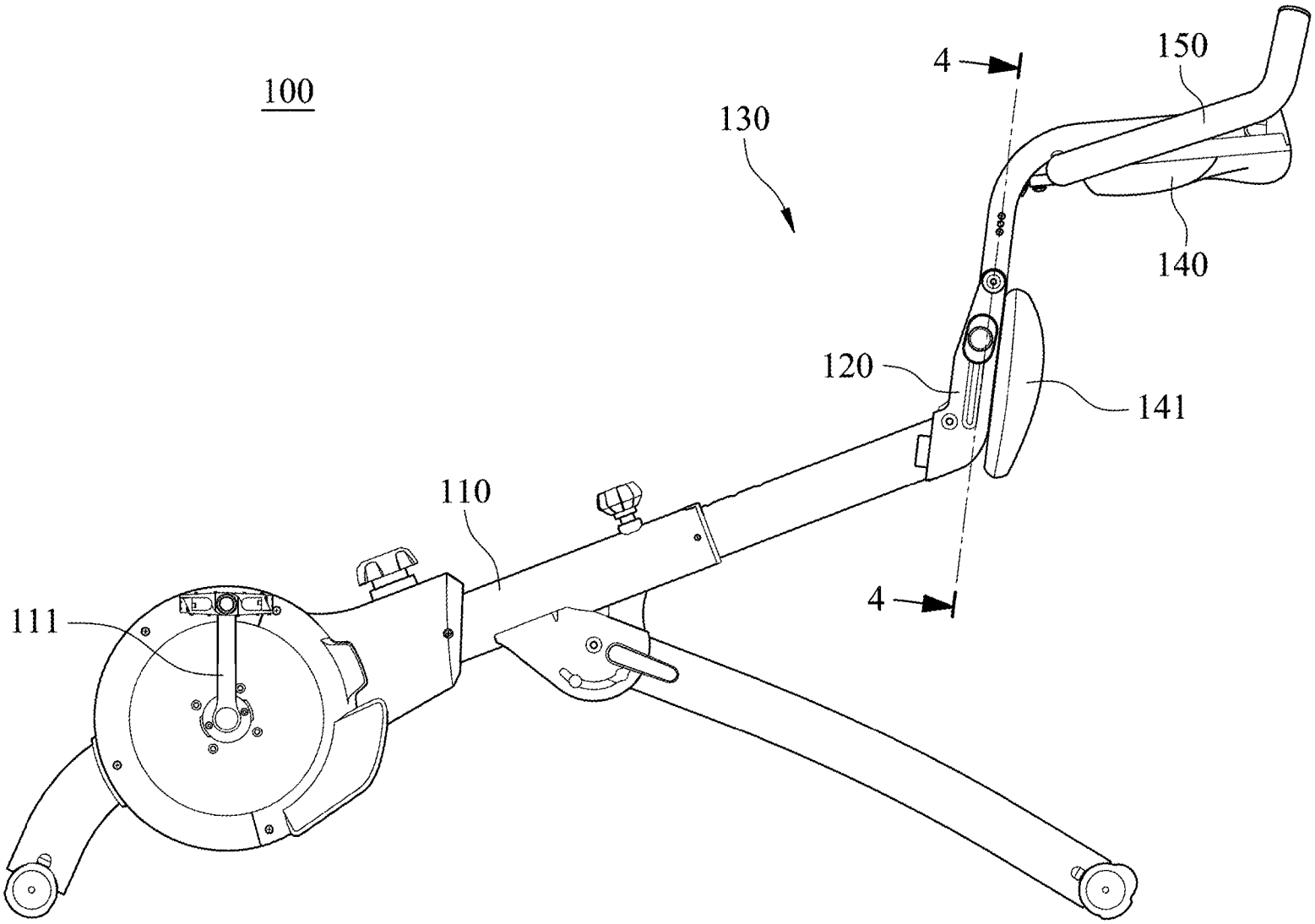
FIG. 4A is a schematic view showing another connection state of the support base of the fitness equipment of FIG. 1.
Figure 4B:
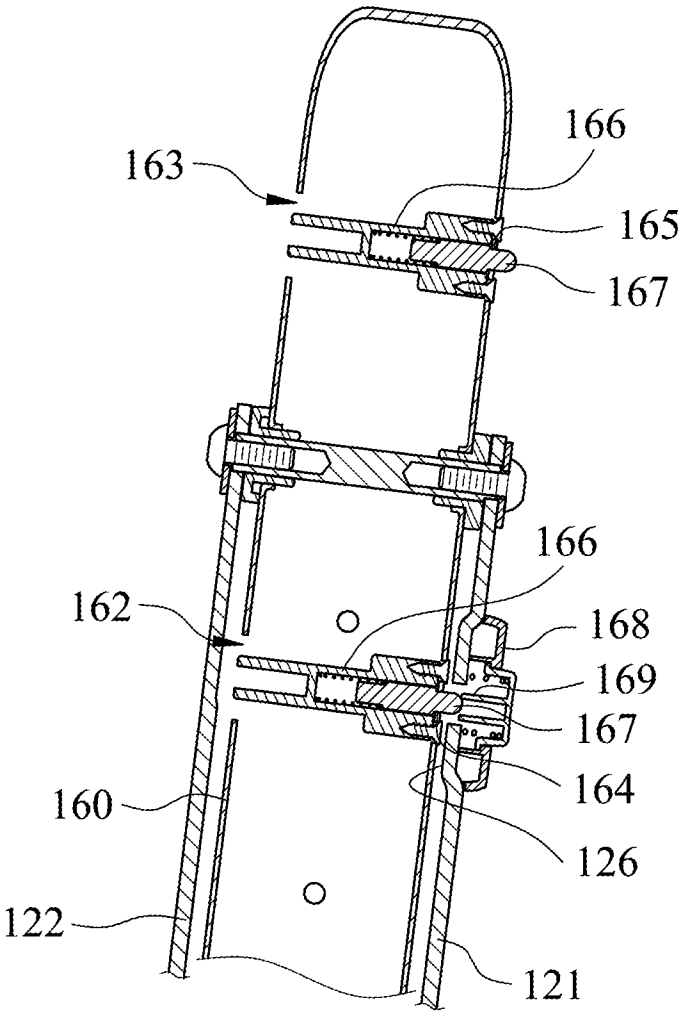
FIG. 4B is a cross-sectional view of the fitness equipment along a section line 4-4 of FIG. 4A.

Please refer to FIG. 3A, FIG. 3B, FIG. 4A and FIG. 4B. FIG. 3A is a schematic view showing a connection state of the support base 130 of the fitness equipment 100 of FIG. 1, FIG. 3B is a cross-sectional view of the fitness equipment 100 along a section line 3-3 of FIG. 3A, FIG. 4A is a schematic view showing another connection state of the support base 130 of the fitness equipment 100 of FIG. 1, and FIG. 4B is a cross-sectional view of the fitness equipment 100 along a section line 4-4 of FIG. 4A.

As shown in FIG. 3A and FIG. 3B, a seating space of the fitness equipment 100 can be further provided when the seat 140 of the support base 130 is connected with the main body 110 in an orientation in which the seat back 141 faces toward the pedal unit 111. The user can sit on the seat 140 and step on the pedal unit 111 for doing the exercise as similar as riding a bicycle so as to exercise the lower limbs. At that time, the major axis of the binding structure 120 is parallel to the major axis of the connecting structure 160. The engagement block 167 of the resilient buckle 166, which sequentially passes through the first mounting hole 162 and the first opening 164, will protrude out of the first opening 164 and not be limited by the first connecting plate 121. The engagement block 167 of the resilient buckle 166, which sequentially passes through the second mounting hole 163 and the second opening 165, will protrude out of the second opening 165 and be limited in the recess hole 127 (as shown in FIG. 2) of the positioning portion 126 of the first connecting plate 121. Thus, the support base 130 is capable of engaging with the recess hole 127 of the binding structure 120 by using the engagement block 167 of the resilient buckle 166. It is favorable for preventing the support base 130 from pivoting correspondingly to the main body 110 in the body-building process. Furthermore, the abutting tube 169 of the button assembly 168 can abut to the engagement block 167 of the resilient buckle 166, which is limited at the recess hole 127, for pressing the engagement block 167.

As shown in FIG. 4A and FIG. 4B, the handlebar 150 is located at the top of the fitness equipment 100 when the support base 130 is pivoted in the arrangement as shown in FIG. 3A so as to be connected with the main body 110 in an orientation that the seat back 141 faces away from the pedal unit 111. Thus, the user can be supported on the handlebar 150 in a prone position and step on the pedal unit 111 for exercising the upper limbs, the trunk and the lower limbs simultaneously. At that time, the major axis of the binding structure 120 is also parallel to the major axis of the connecting structure 160. The engagement block 167 of the resilient buckle 166, which sequentially passes through the second mounting hole 163 and the second opening 165, will protrude out of the second opening 165 and not be limited by the first connecting plate 121. The engagement block 167 of the resilient buckle 166, which sequentially passes through the first mounting hole 162 and the first opening 164, will protrude out of the first opening 164 and be limited in the recess hole 127 (as shown in FIG. 2) of the positioning portion 126 of the first connecting plate 121. Thus, the support base 130 is capable of engaging with the recess hole 127 of the binding structure 120 by using the engagement block 167 of the resilient buckle 166. It is favorable for preventing the support base 130 from pivoting correspondingly to the main body 110 in the body-building process. Furthermore, the abutting tube 169 of the button assembly 168 can abut to the engagement block 167 of the resilient buckle 166 which is limited at the recess hole 127 for pressing the engagement block 167. Accordingly, the safety of using the fitness equipment 100 of the present disclosure can be substantially improved.

Figure 5:
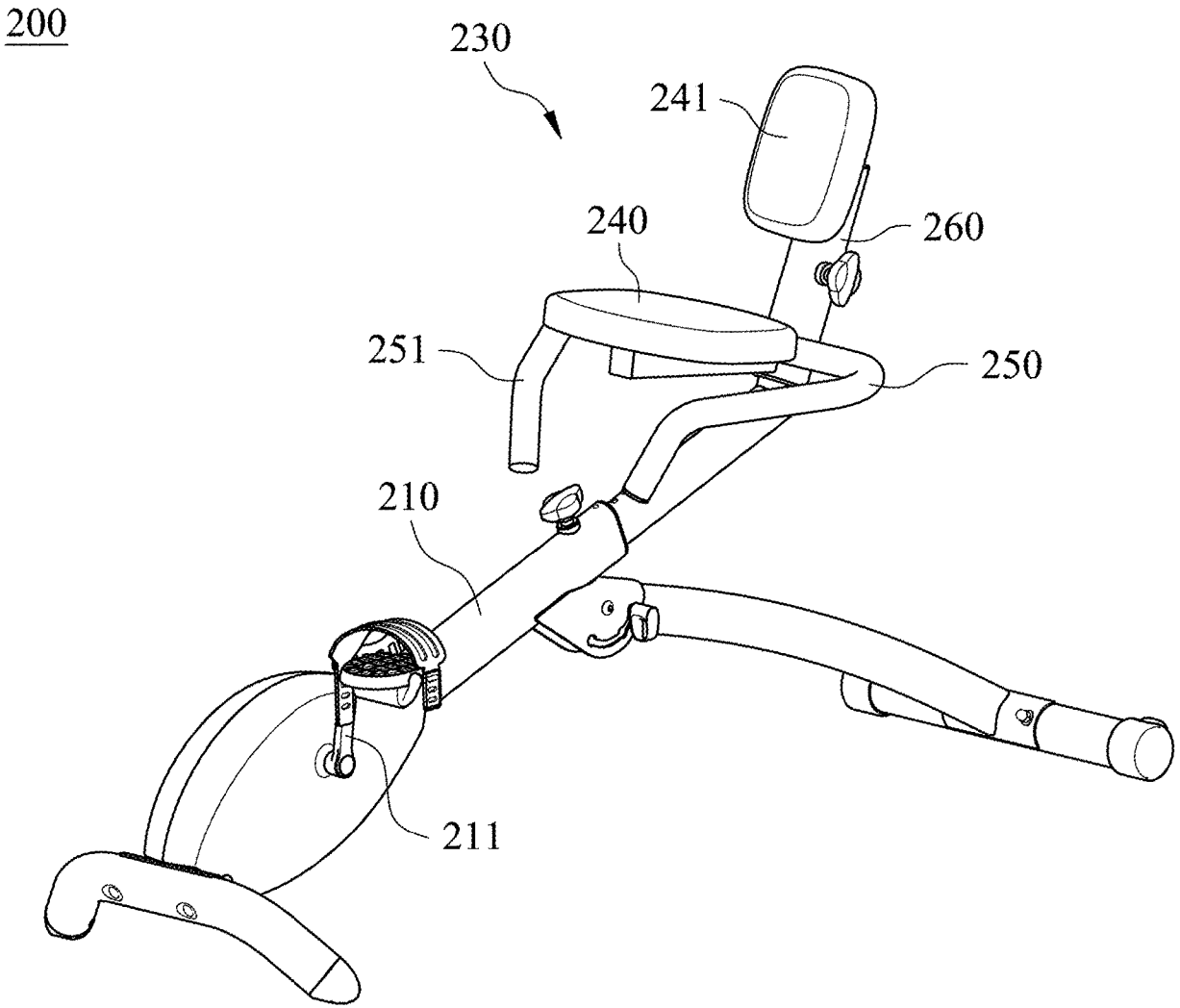
FIG. 5 is a schematic view of a fitness equipment according to one example of another embodiment of the present disclosure.
Figure 6:
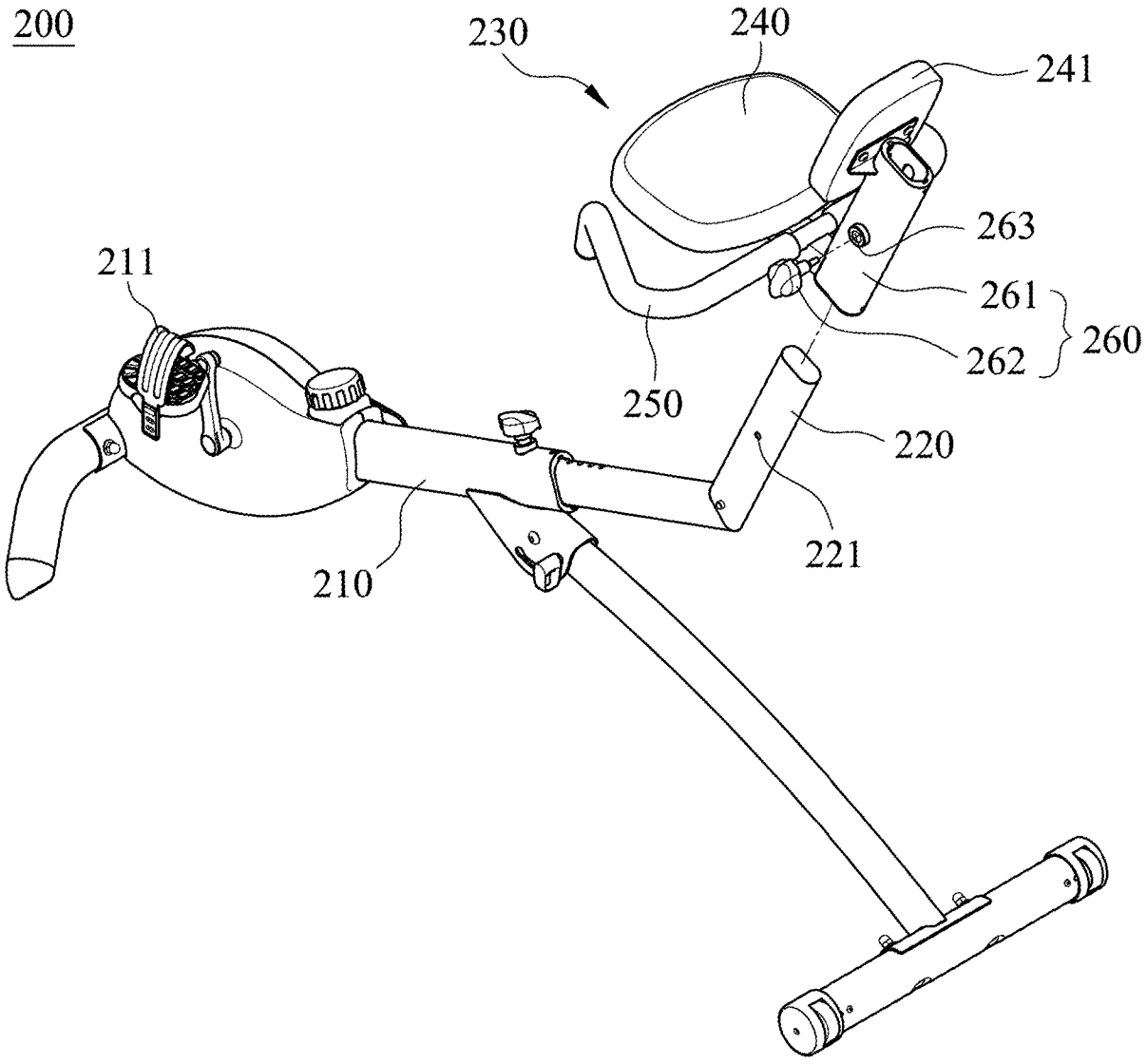
FIG. 6 is a schematic view showing a connection between a support base and a binding structure of the fitness equipment of FIG. 5.
Figure 7:
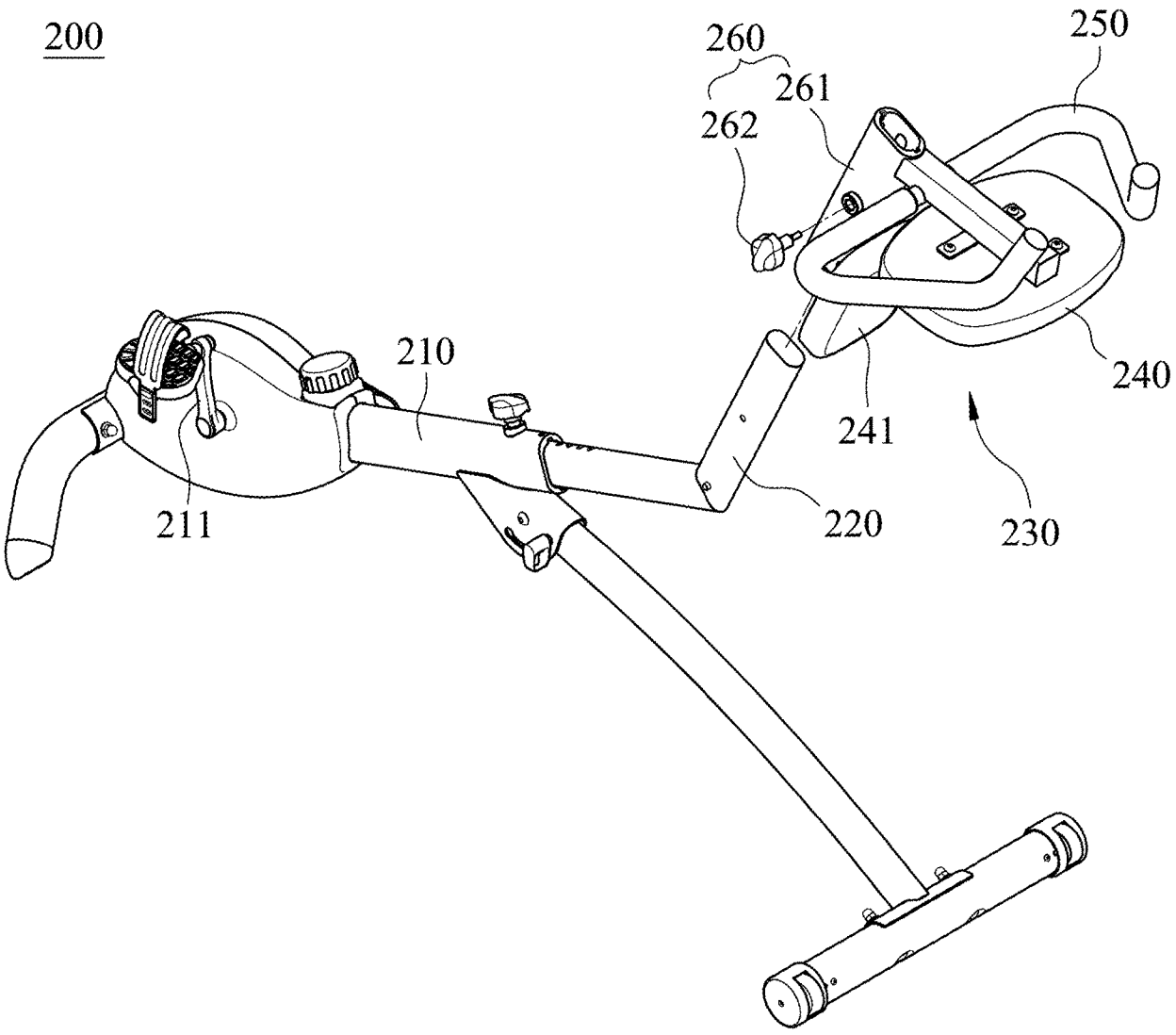
FIG. 7 is a schematic view showing another connection between the support base and the binding structure of the fitness equipment of FIG. 5.

Please refer to FIG. 5, FIG. 6 and FIG. 7. FIG. 5 is a schematic view of a fitness equipment 200 according to one example of another embodiment of the present disclosure, FIG. 6 is a schematic view showing a connection between a support base 230 and a binding structure 200 of the fitness equipment 200 of FIG. 5, and FIG. 7 is a schematic view showing another connection between the support base 230 and the binding structure 220 of the fitness equipment 200 of FIG. 5. The fitness equipment 200 includes a main body 210, the binding structure 220 (as shown in FIG. 6) and the support base 230.

The main body 210 is supported on the ground and includes a pedal unit 211. The binding structure 220 is disposed on the main body 210. The support base 230 is detachably disposed at the binding structure 220 and includes a seat 240, a handlebar 250 and a connecting structure 260. The handlebar 250 is disposed on the seat 240. The connecting structure 260 is disposed on the seat 240 and detachably connected to the binding structure 220. Accordingly, by using the detachable support base 230, the arrangement of the support base 230 correspondingly to the main body 210 can be changed according to the actual demand. It is favorable for the user to change the exercise mode during the body-building process and exercise different parts of the body. Therefore, the fitness equipment 100 of the present disclosure can be operated more conveniently and applied broadly, and the size and occupied space of the fitness equipment 200 can be effectively reduced. Furthermore, the demand for different exercise modes can be satisfied.

In the embodiment of FIG. 6, the seat 240 includes a seat back 241. The connecting structure 260 is disposed on the seat back 241 and includes a connecting tube 261 and a fixing member 262. The connecting tube 261 is sleeved on the rod-shaped binding structure 220 for disposing the support base 230 on the main body 210 by the binding structure 220. The connecting tube 261 can include at least one via hole 263, and the fixing member 262 sequentially passes through the via hole 263 and a through hole 221 of the binding structure 220 for fixing the connecting tube 261 and the binding structure 220 and preventing the support base 230 from falling off.

It must be noted that the connecting structure 260 can be threadedly or serially connected to the binding structure 220 by using the fixing member 262, and the via hole 263 can be a through hole or a threaded hole depended on the demand. Optionally, a tightening method performed on single surface also can enhance the fixing effect of the fixing member 262. Moreover, the connecting tube 261 can include two via holes 263 for the fixing member 262 to pass through. However, the present disclosure is not limited thereto.

As shown in FIG. 6, a seating space of the fitness equipment 200 can be further provided when the seat 240 of the support base 230 is connected with the main body 210 in an orientation in which the seat back 241 faces toward the pedal unit 211. The user can sit on the seat 240 and step on the pedal unit 211 for doing the exercise as similar as riding a bicycle so as to exercise the lower limbs. Otherwise, as shown in FIG. 7, the seat 240 of the support base 230 is connected with the main body 210 in an orientation in which the seat back 241 faces away from the pedal unit 211. In the meanwhile, the connecting tube 261 of the connecting structure 260 can be sleeved to the binding structure 220 from one end which is different from the example shown in FIG. 6 so as to allow the handlebar 250 to be located at the top of the fitness equipment 200. Thus, the user can be supported on the handlebar 250 in a prone position and then step on the pedal unit 211 for exercising the upper limbs, the trunk and the lower limbs simultaneously. Accordingly, the fitness equipment 200 of the present disclosure can change the connecting method between the support base 230 and the binding structure 220. It is favorable for the user to change the exercise mode during the body-building process and exercise different parts of the body. Thus, the fitness equipment 200 of the present disclosure can be operated more conveniently and applied broadly.

As shown in FIG. 5, each of two ends of the handlebar 250 is bent to form a grip portion 251 for holding by a user. Therefore, the safety of using the fitness equipment 200 provided in the present disclosure will be enhanced.

Figure 8:
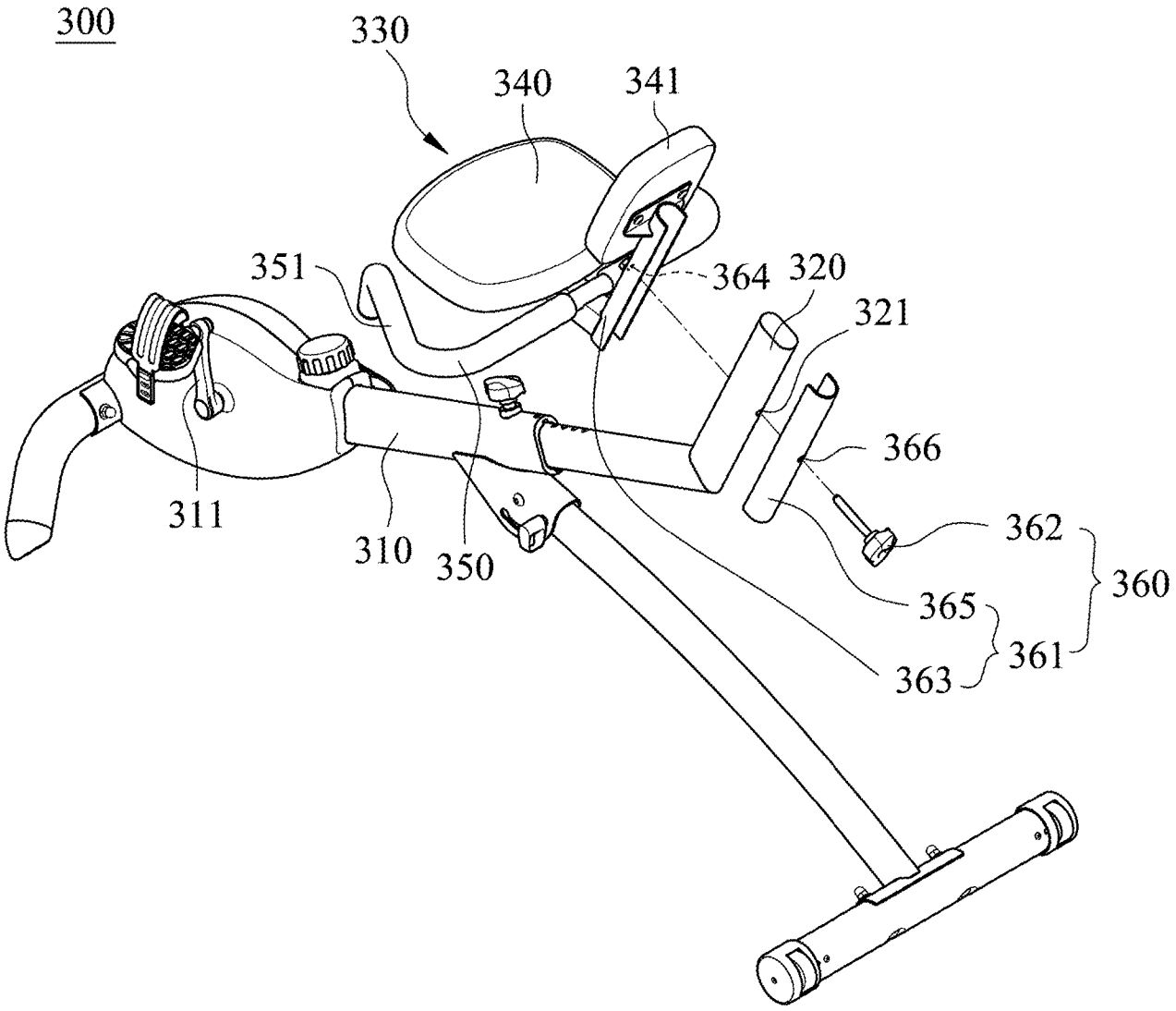
FIG. 8 is a schematic view showing a connection between a support base and a binding structure of a fitness equipment according to another example of another embodiment of the present disclosure.
Figure 9:
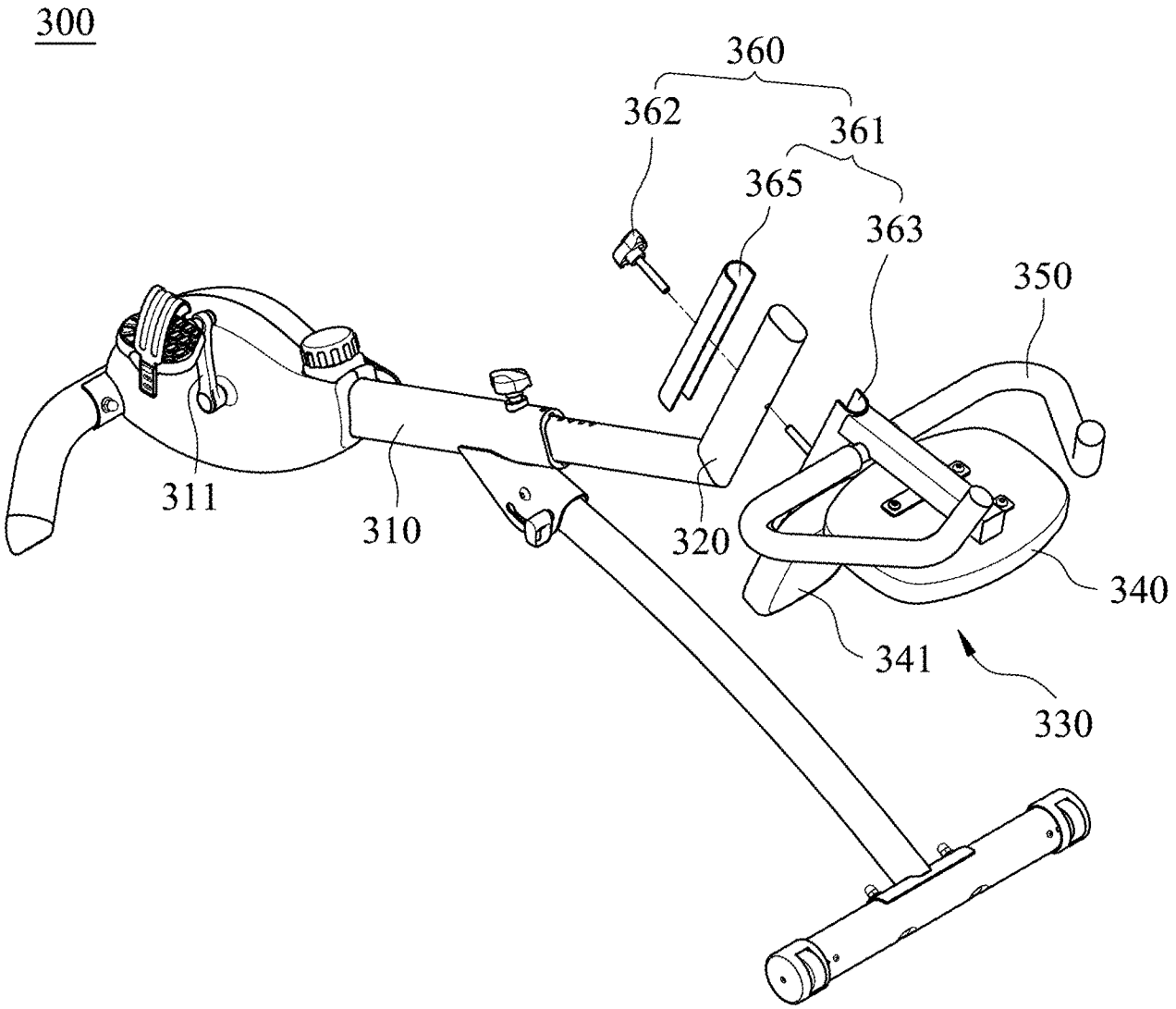
FIG. 9 is a schematic view showing another connection between the support base and the binding structure of the fitness equipment of FIG. 8.

Please refer to FIG. 8 and FIG. 9. FIG. 8 is a schematic view showing a connection between a support base 330 and a binding structure 320 of a fitness equipment 300 according to another example of another embodiment of the present disclosure, and FIG. 9 is a schematic view showing another connection between the support base 330 and the binding structure 320 of the fitness equipment 300 of FIG. 8. The fitness equipment 300 includes a main body 310, the binding structure 320 and the support base 330.

The main body 310 is supported on the ground and includes a pedal unit 311. The binding structure 320 is disposed on the main body 310. The support base 330 is detachably disposed on the binding structure 320 and includes a seat 340, a handlebar 350 and a connecting structure 360. The handlebar 350 is disposed on the seat 340. The connecting structure 360 is disposed on the seat 340 and detachably connected to the binding structure 320. Accordingly, the fitness equipment 300 of the present disclosure can change the arrangement of the support base 330 correspondingly to the main body 310 according to the actual demand by utilizing the detachably design of the support base 330. Therefore, the size and occupied space of the fitness equipment 300 can be effectively reduced. Furthermore, the demand for different exercise modes can be satisfied.

As shown in FIG. 8 and FIG. 9, the seat 340 includes a seat back 341. The connecting structure 360 is disposed on the seat back 341 and includes a connecting tube 361 and a fixing member 362. The connecting tube 361 is sleeved on the rod-shaped binding structure 320. Preferably, as shown in FIG. 8, the connecting tube 361 can include a first tube member 365 and a second tube member 363. The first tube member 365 includes a first via hole 366, and the second tube member 363 includes a second via hole 364. The first tube member 365 and the second tube member 363 are disposed opposite to each other. The binding structure 320 includes a through hole 321, the fixing member 362 sequentially passes through the first via hole 366, and the through hole 321 and the second via hole 364 for fixing the connecting tube 361 and the binding structure 320. Alternatively, the fixing member 362 can sequentially pass through the second via hole 364, the through hole 321 and the first via hole 366. Because the connecting tube 361 is provided by opposite assembling the first tube member 365 and the second tube member 363, it is favorable for detaching and assembling the support base 330 so that the fitness equipment 300 will be operated more conveniently. Furthermore, each of two ends of the handlebar 350 is bent to form a grip portion 351 for holding by a user. Thus, the safety of using the fitness equipment 300 provided in the present disclosure will be enhanced.

It must be noted that the connecting structure 360 can be threadedly or serially connected to the binding structure 320 by using the fixing member 362. The first via hole 366 and the second via hole 364 can be through holes or threaded holes depended on the demand. The fixing member 362 can be any member with the fixing effect, such as a threaded screw, a threaded knob and so on. However, the present disclosure is not limited thereto.

As shown in FIG. 8, a seating space of the fitness equipment 300 can be further provided when the seat 340 of the support base 330 is connected with the main body 310 in an orientation in which the seat back 341 faces toward the pedal unit 311. The user can sit on the seat 340 and step on the pedal unit 311 for doing the exercise as similar as riding a bicycle so as to exercise the lower limbs. In FIG. 9, when the seat 340 of the support base 330 is connected with the main body 310 in an orientation in which the seat back 341 faces away from the pedal unit 311, the first tube member 365 and the second tube member 363 will exchange their disposed positions correspondingly to the binding structure 320 and connected with the binding structure 320. At that time, the handlebar 350 is located at the top of the fitness equipment 300 and thus the user can be supported on the handlebar 350 in a prone position and step on the pedal unit 311 for exercising the upper limbs, the trunk and the lower limbs simultaneously. Accordingly, the fitness equipment 300 can change the connection between the support base 330 and the binding structure 320 according to the actual demand. It is favorable for the user to change the exercise mode during the body-building process and exercise different parts of the body. Thus, the fitness equipment 300 of the present disclosure can be operated more conveniently and applied broadly.

Figure 10:
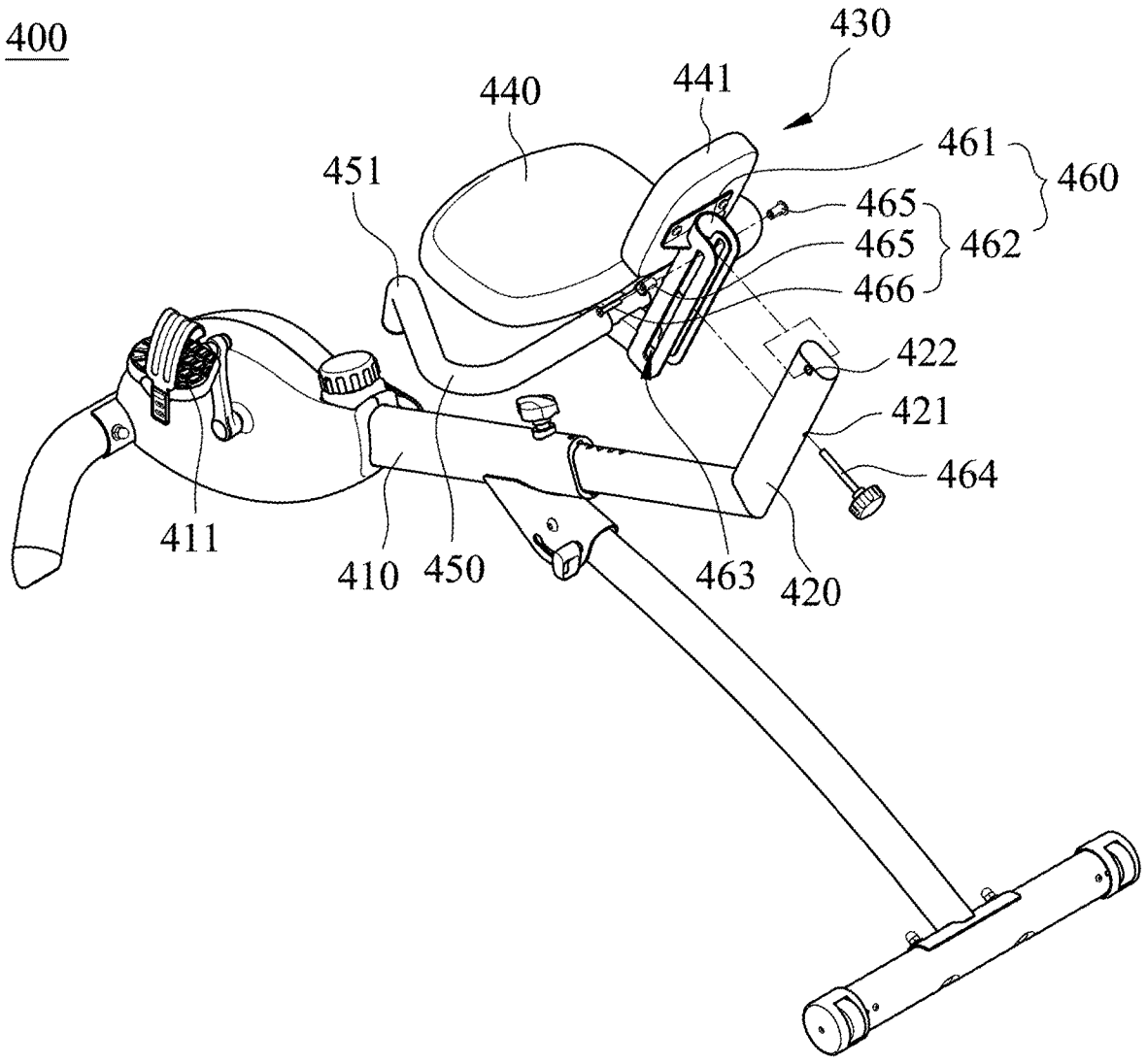
FIG. 10 is a schematic view showing a connection between a support base and a binding structure of a fitness equipment according to yet another example of another embodiment of the present disclosure.

Please refer to FIG. 10, which is a schematic view showing a connection between a support base 430 and a binding structure 420 of a fitness equipment 400 according to yet another example of another embodiment of the present disclosure. The fitness equipment 400 includes a main body 410, the binding structure 420 and the support base 430.

The main body 410 is supported on the ground and includes a pedal unit 411. The binding structure 420 is disposed on the main body 410. The support base 430 is detachably disposed at the binding structure 420 and includes a seat 440, a handlebar 450 and a connecting structure 460. The handlebar 450 is disposed on the seat 440. The connecting structure 460 is disposed on the seat 440 and detachably connected to the binding structure 420. More preferably, the seat 440 can include a seat back 441, and the connecting structure 460 is disposed on the seat back 441, but the present disclosure is not limited to be. Accordingly, the fitness equipment 400 of the present disclosure can change the arrangement of the support base 430 correspondingly to the main body 410 according to the actual body-building demand by utilizing the detachably design of the support base 430. Therefore, the size and occupied space of the fitness equipment 400 can be effectively reduced. Furthermore, the demand for different exercise modes can be satisfied.

In the embodiment of FIG. 10, the binding structure 420 includes an end through hole 422 and a through hole 421. Furthermore, the connecting structure 460 includes a connecting base 461 and a connecting unit 462. The connecting base 461 is correspondingly disposed at the binding structure 420 and includes two sliding grooves 463 opposite to each other. The connecting unit 462 sequentially passes through one the sliding grooves 463, the end through hole 422 and the other one of the sliding grooves 463 so as to connect the connecting base 461 with the binding structure 420. Preferably, in the embodiment of FIG. 10, the connecting structure 460 can further include a fixing member 464. The fixing member 464 is detachably connected to the binding structure 420 for fixing the binding structure 420 and the connecting base 461. Preferably, the fixing member 464 can be any member with the fixing effect, such as a threaded screw, a threaded knob and so on. However, the present disclosure is not limited thereto. The connecting unit 462 can include two sleeve members 465 and a connecting member 466. The two sleeve members 465 passes through the two sliding grooves 463 and two sides of the end through hole 422, respectively. The connecting member 466 is sequentially inserted into the two sleeve members 465 for correspondingly assembling the binding structure 420 in the connecting base 461. Accordingly, the connecting unit 462 can be fixedly inserted into the end through hole 422 through the arrangement of the two sleeve members 465 and the connecting member 466, in which the two sleeve members 465 will abut to side edges of the two sliding grooves 463, respectively, so as to avoid the connecting base 461 from being loose and moved related to the binding structure 420. Furthermore, each of two ends of the handlebar 450 is bent to form a grip portion 451 for holding by a user. Therefore, the safety of using the fitness equipment 400 provided in the present disclosure will be enhanced.

Figure 11A:
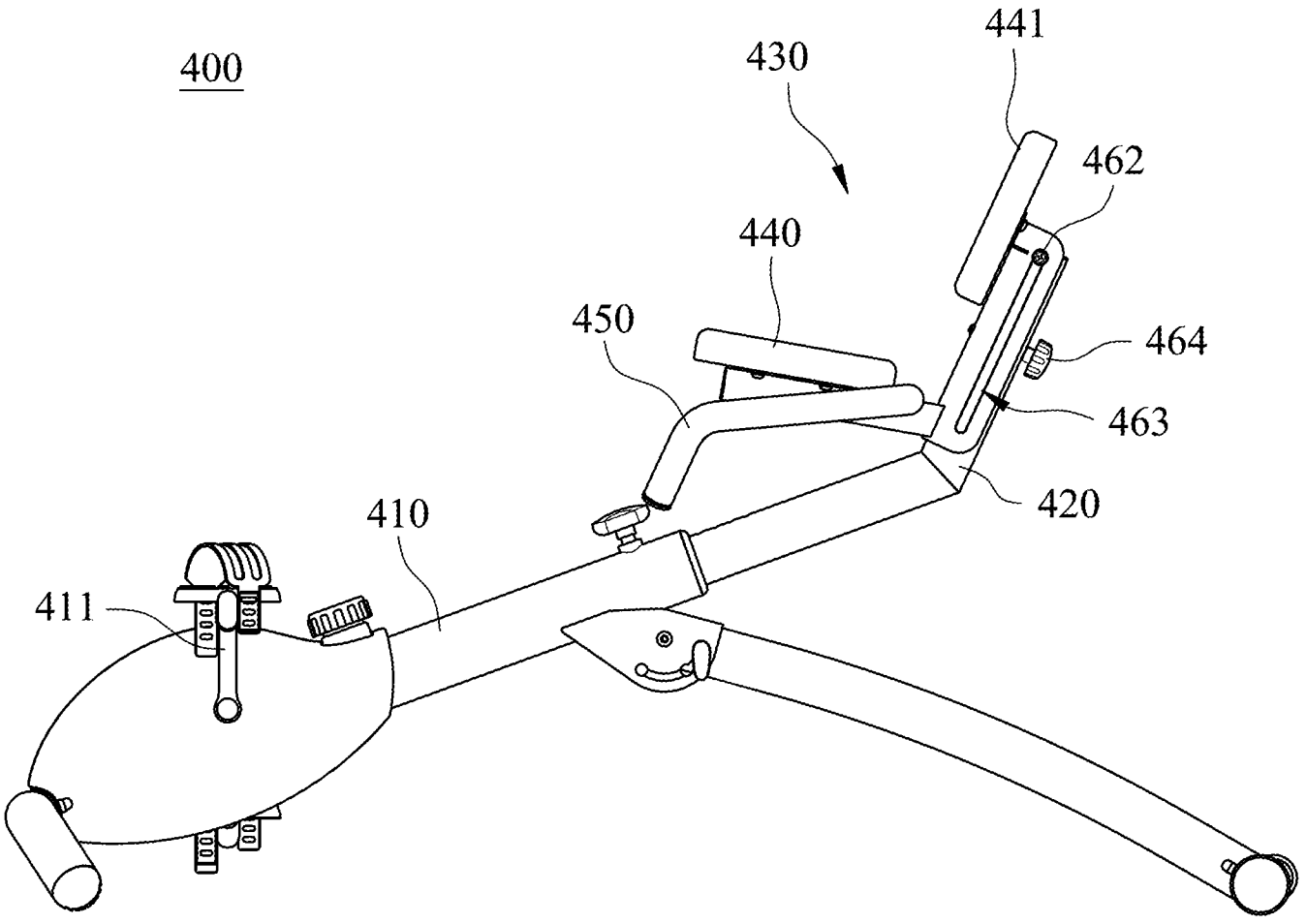
FIG. 11A is a schematic view showing a connection state of the support base of the fitness equipment of FIG. 10.
Figure 11B:
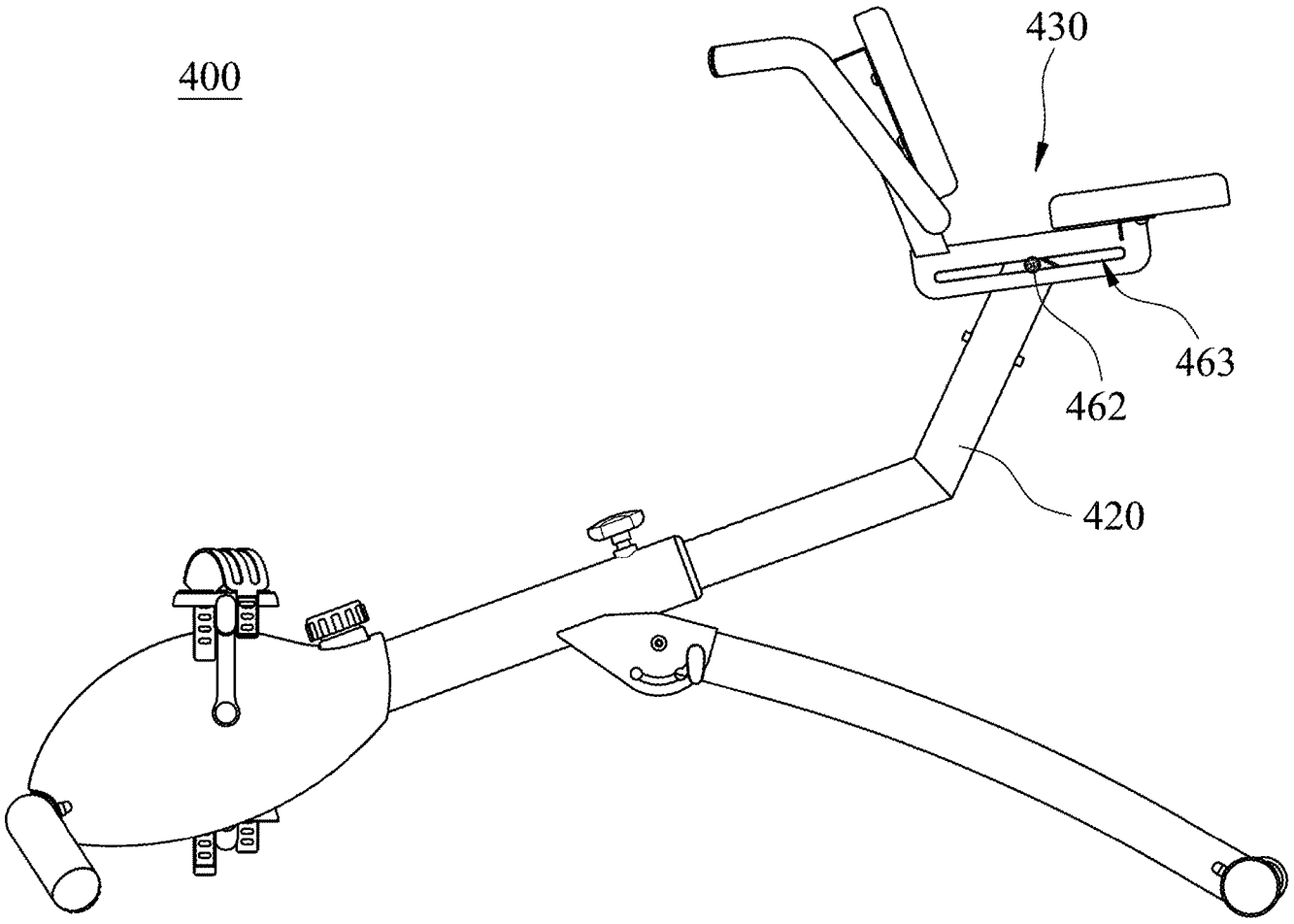
FIG. 11B is a schematic view showing a rotational operation of the support base of the fitness equipment of FIG. 11A.
Figure 11C:
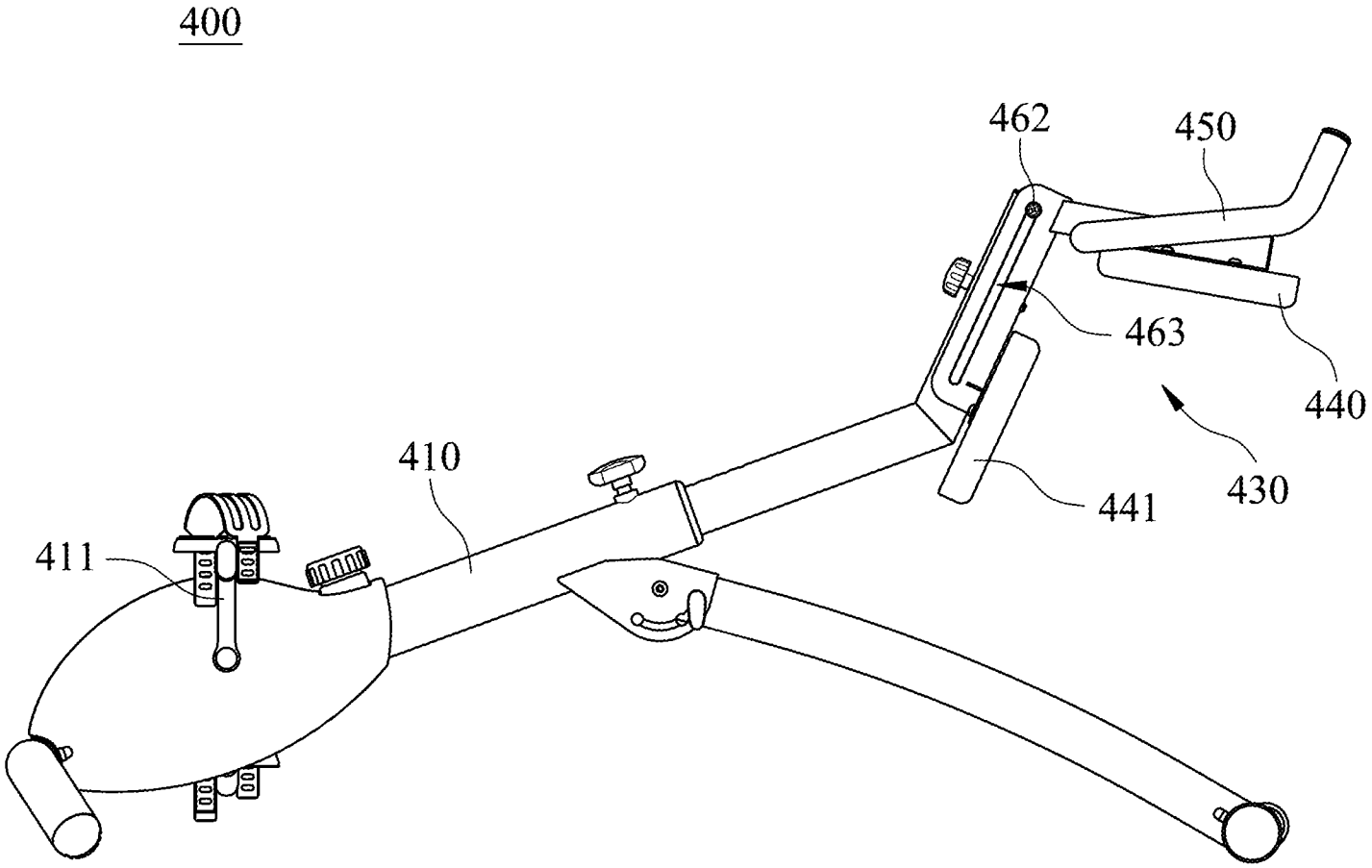
FIG. 11C is a schematic view showing another connection state of the support base of the fitness equipment of FIG. 10.

Please refer to FIG. 11A, FIG. 11B and FIG. 11C. FIG. 11A is a schematic view showing a connection state of the support base 430 of the fitness equipment 400 of FIG. 10, FIG. 11B is a schematic view showing a rotational operation of the support base 430 of the fitness equipment 400 of FIG. 11A, and FIG. 11C is a schematic view showing another connection state of the support base 430 of the fitness equipment 400 of FIG. 10.

As shown in FIG. 11A, a seating space of the fitness equipment 400 can be further provided when the seat 440 of the support base 430 is connected with the main body 410 in an orientation in which the seat back 441 faces toward the pedal unit 411. The user can sit on the seat 440 and step on the pedal unit 411 for doing the exercise as similar as riding a bicycle so as to exercise the lower limbs. As shown in FIG. 11B, the support base 430 can use the connecting unit 462, which is fixed and inserted into the end through hole 422 (as shown in FIG. 10), as a fulcrum and further utilize the limitation and guiding of the two sliding grooves 463 to move and rotate correspondingly to the binding structure 420. Accordingly, the arrangement of the support base 430 correspondingly to the main body 410 is changed. When the support base 430 is moved to allow the two connecting units 462 to contact the other ends, which are opposite to the ends shown in FIG. 11A, of the two sliding grooves 463, the seat 440 of the support base 530 is connected with the main body 410 in an orientation in which the seat back 441 faces away from the pedal unit 411 as shown in FIG. 11C. At that time, the handlebar 450 is located at the top of the fitness equipment 400 and thus the user can be supported on the handlebar 450 in a prone position and step on the pedal unit 411 for exercising the upper limbs, the trunk and the lower limbs simultaneously. Accordingly, through the two sliding grooves 463, the fitness equipment 400 of the present disclosure can change the connecting type of the support base 430 correspondingly to the binding structure 420 without releasing the connection between the support base 430 and the binding structure 420. Thus, the present disclosure can satisfy the demands for different exercise modes and is more convenient for using.

Figure 12:
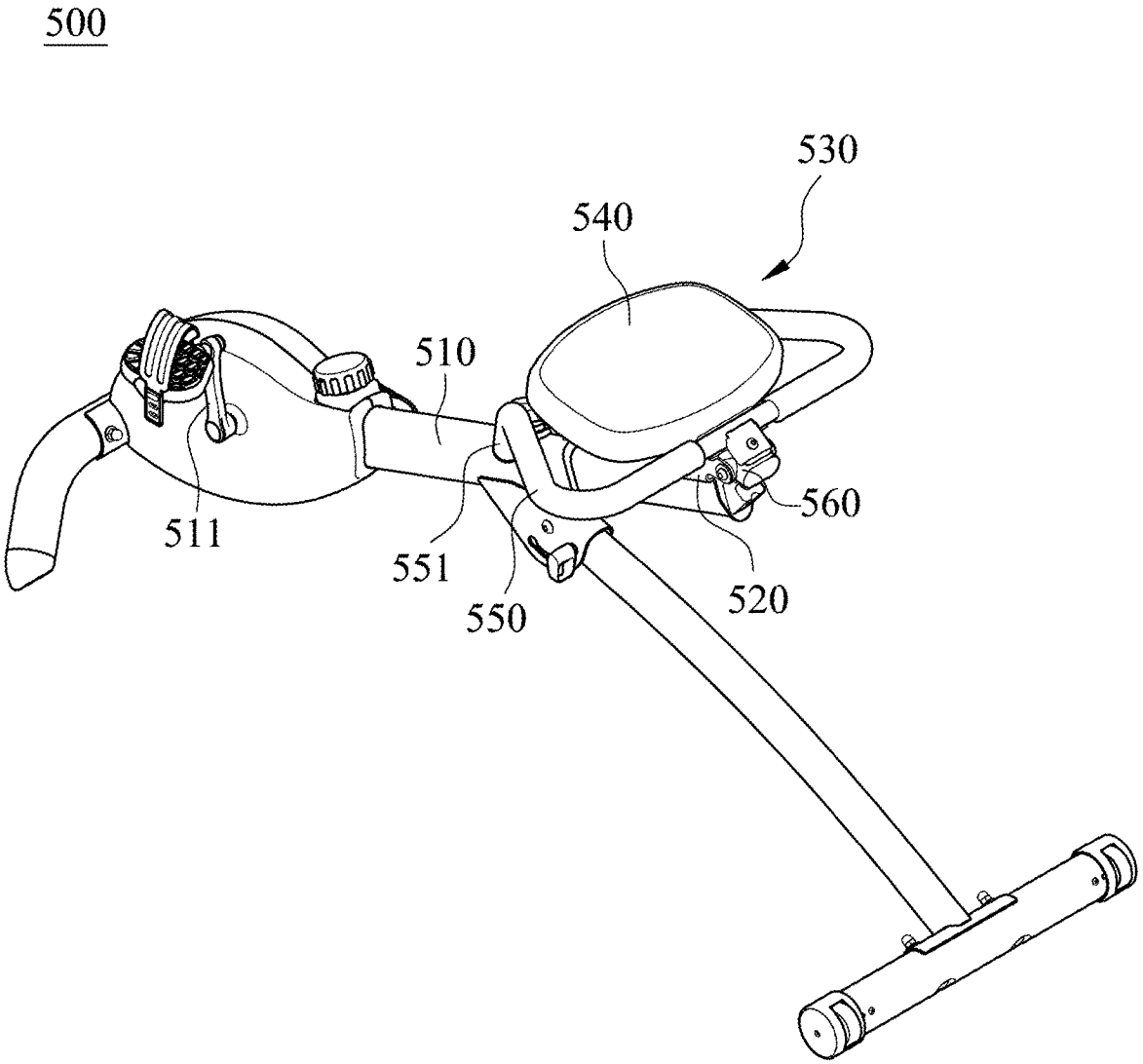
FIG. 12 is a schematic view of a fitness equipment according to another example of the embodiment of the present disclosure.
Figure 13:
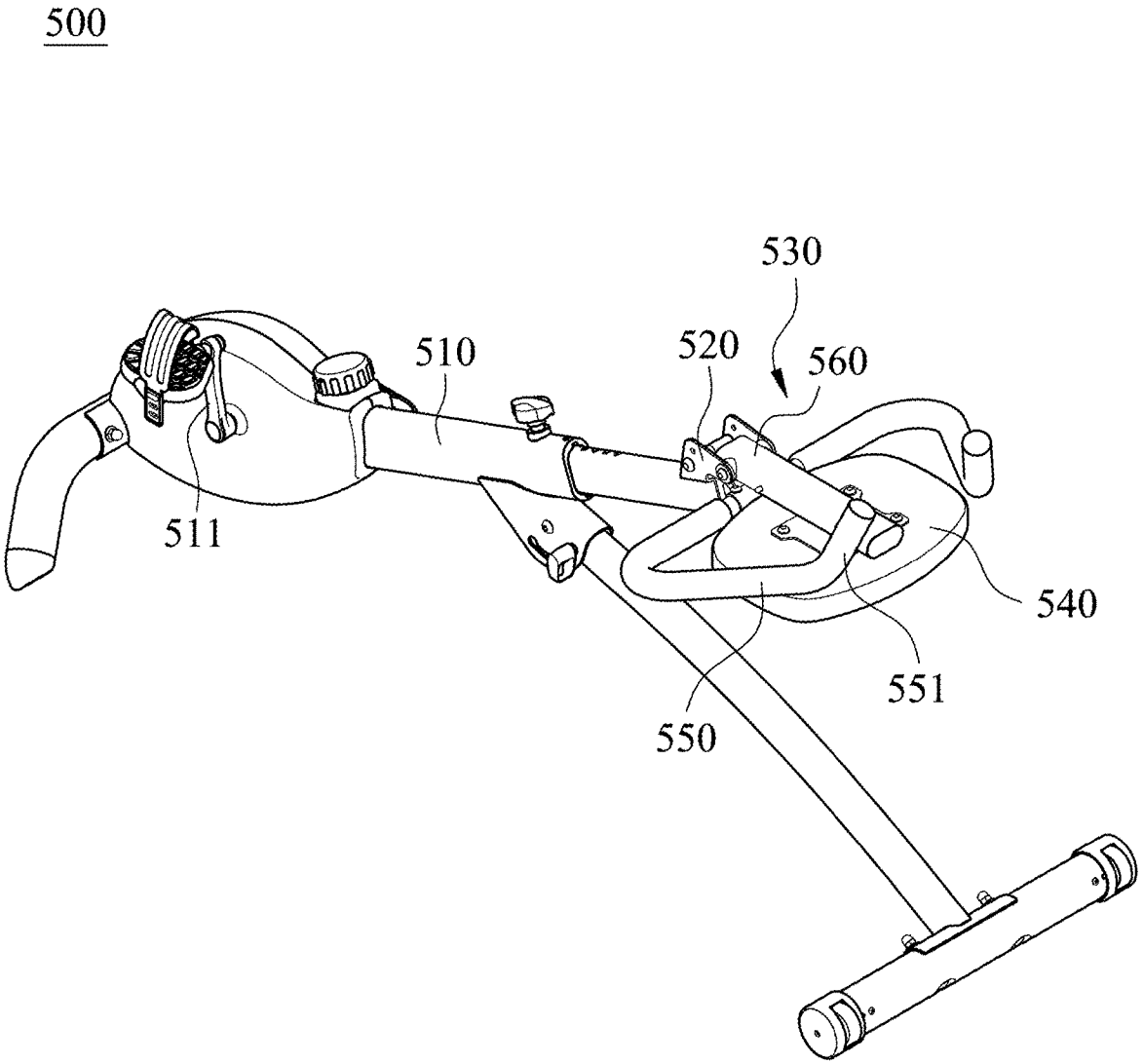
FIG. 13 is another schematic view of the fitness equipment of FIG. 12.

Please refer to FIG. 12 and FIG. 13. FIG. 12 is a schematic view of a fitness equipment 500 according to another example of the embodiment of the present disclosure, and FIG. 13 is another schematic view of the fitness equipment 500 of FIG. 12. The fitness equipment 500 includes a main body 510, a binding structure 520 and a support base 530.

The main body 510 is supported on the ground and includes a pedal unit 511. The binding structure 520 is disposed on the main body 510. The support base 530 is detachably pivoted at the binding structure 520 and rotatable correspondingly to the main body 510, whereon the support base 530 includes a seat 540, a handlebar 550 and a connecting structure 560. The handlebar 550 is disposed on the seat 540. Preferably, as shown in FIG. 12, each of two ends of the handlebar 550 is bent to form a grip portion 551 for holding by a user. Therefore, the safety of using the fitness equipment 500 of the present disclosure will be enhanced. The connecting structure 560 is disposed on the seat 540 and detachably pivoted to the binding structure 520.

As shown in FIG. 12 and FIG. 13, a seating space of the fitness equipment 500 can be further provided when the seat 540 of the support base 530 is connected with the main body 510 in an orientation in which the surface (not shown in the figure) of the seat 540 faces upward. The user can sit on the seat 540 and step on the pedal unit 511 for doing the exercise as similar as riding a bicycle so as to exercise the lower limb. In FIG. 13, the handlebar 550 is located at the top of the fitness equipment 500 when the support base 530 is pivoted from the arrangement as shown in FIG. 12 so as to be connected with the main body 510 in an orientation in which the surface of the seat faces toward the ground. Therefore, the user can be supported on the handlebar 550 in a prone position and step on the pedal unit 511 for exercising the upper limb, the trunk and the lower limb simultaneously.

Accordingly, by using the support base 530 of the present disclosure, the arrangement of the support base 530 correspondingly to the main body 510 can be changed according to the actual demand without detaching the whole support base 530 from the main body 510. It is favorable for the user to change the exercise mode during the body-building process and exercise different parts of the body. Therefore, the fitness equipment 500 of the present disclosure can be operated more conveniently and applied broadly.

To sum up, the fitness equipment of the present disclosure has advantages listed as follows. First, the arrangement of the support base can be changed according to the actual demand through the detachably design thereof. Thus, different body-building structures are unnecessary so as to effectively reduce the volume and occupied space of the fitness equipment. Second, the connection between the support base and the binding structure can be changed according to the actual demand by using the detachable support base. It is beneficial for the user to change the exercise mode during the body-building process and exercise different parts of the body. Thus, the fitness equipment of the present disclosure can be operated more conveniently and applied broadly. Third, by the setting of the binding structure, the connection of the support base correspondingly to the main body can be changed without releasing the connection between the support base and the binding structure. Accordingly, the present disclosure can satisfy the demands for different exercise modes and is more convenient for using.

Although the present disclosure has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. Fitness equipment, comprising:

a main body supported on the ground and comprising a pedal unit;

a binding structure disposed on the main body; and a support base detachably pivoted to the binding structure and being rotatable with respect to the main body, wherein the support base comprises:

a seat;

a handlebar disposed on the seat; and a connecting structure disposed on the seat and detachably pivotable to the binding structure, wherein the connecting structure comprises two via holes opposite and connected to each other, and the binding structure comprises:

a first connecting plate disposed on the main body and comprising a first end through hole;

a second connecting plate disposed on the main body and comprising a second end through hole, wherein the first connecting plate and the second connecting plate are opposite to each other; and a connecting unit passing through the first end through hole of the first connecting plate, one of the two via holes, the other one of the two via holes and the second end through hole of the second connecting plate for connecting the connecting structure with the binding structure.

2. The fitness equipment of claim 1, wherein the connecting structure further comprises:

a first mounting hole disposed on one side adjacent to the second connecting plate, of the connecting structure;

a first opening disposed on one side adjacent to the first connecting plate, of the connecting structure, wherein the first mounting hole and the first opening are opposite and connected to each other;

a second mounting hole disposed on one side adjacent to the second connecting plate, of the connecting structure, wherein the second mounting hole and the first mounting hole are separately disposed;

a second opening disposed on one side adjacent to the first connecting plate, of the connecting structure, wherein the second mounting hole and the second opening are opposite and connected to each other, and the first opening and the second opening are disposed at two sides of the two via holes, respectively; and two resilient buckles respectively disposed in the connecting structure, wherein each of the two resilient buckles comprises an engagement block repositioned disposed on one end of each of the two resilient buckles, in which one of the engagement blocks is correspondingly disposed on and protruded out of the first opening, and the other one of the engagement blocks is correspondingly disposed on and protruded out of the second opening.

3. The fitness equipment of claim 2, wherein the first connecting plate further comprises:

a positioning portion disposed on a surface of the first connecting plate, which is oriented to the second connecting plate, and the positioning portion comprising at least one recess hole;

wherein the at least one recess hole of the first connecting plate is for limiting the engagement block of each of the two resilient buckles when a major axis of the binding structure is parallel to a major axis of the connecting structure.

4. The fitness equipment of claim 3, wherein the binding structure further comprises:

a button assembly correspondingly disposed on the at least one recess hole of the first connecting plate for pressing the engagement block of each of the two resilient buckles limited by the at least one recess hole so as to allow the engagement block to be released from the limitation of the at least one recess hole.

5. The fitness equipment of claim 4, wherein the button assembly comprises at least one abutting tube correspondingly disposed on the at least one recess hole.

6. The fitness equipment of claim 3, wherein the first connecting plate further comprises:

two inclined portions disposed on the positioning portion and located at two sides of the at least one recess hole, respectively.

7. The fitness equipment of claim 3, wherein the first connecting plate comprises two recessed holes, and the two recessed holes are configured to limit the two engagement blocks of the two resilient buckles, respectively.

8. The fitness equipment of claim 1, wherein the seat comprises a seat back, and the connection structure is disposed on the seat back.

9. The fitness equipment of claim 1, wherein each of two ends of the handlebar is bent to form a grip portion configured to be held by a user.

* * * * *